US006533593B1

(12) United States Patent
Ishii

(10) Patent No.: US 6,533,593 B1
(45) Date of Patent: Mar. 18, 2003

(54) COAXIAL CONNECTOR WITH SELECTOR SWITCH

(75) Inventor: Yoshiharu Ishii, Yokohama (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 09/914,226

(22) PCT Filed: Dec. 27, 2000

(86) PCT No.: PCT/JP00/09286

§ 371 (c)(1),
(2), (4) Date: Aug. 24, 2001

(87) PCT Pub. No.: WO01/48872

PCT Pub. Date: Jul. 5, 2001

(30) Foreign Application Priority Data

Dec. 27, 1999 (JP) ..... 11-371802

(51) Int. Cl.[7] ..... H01R 29/00
(52) U.S. Cl. ..... 439/188; 200/51.1
(58) Field of Search ..... 439/188, 63, 581; 200/51.09, 51.1, 504

(56) References Cited

U.S. PATENT DOCUMENTS 4,937,404 A * 6/1990 Kitagawa
5,775,927 A * 7/1998 Wider ..... 439/188
6,296,492 B1 * 10/2001 Fujimoto et al. ..... 439/63
2002/0025707 A1 * 2/2002 Hida ..... 439/188

FOREIGN PATENT DOCUMENTS

| | | |
|---|---|---|
| JP | 2-140716 | 11/1990 |
| JP | 4-96918 | 8/1992 |
| JP | 5-1184 | 1/1993 |

* cited by examiner

*Primary Examiner*—Renee Luebke
*Assistant Examiner*—Phuong Nguyen
(74) *Attorney, Agent, or Firm*—Finnegan, Henderson, Farabow, Garrett & Dunner L.L.P.

(57) ABSTRACT

A coaxial connector with a selector switch is one which a pressing force of the coaxial plug (12) as it is connected to the coaxial connector is applied to one of the pair of contacts (6, 7) through the selector terminals (21) to disengage the pair of contacts (6, 7) from each other and to electrically connect the one of the pair of contacts (6), to a contact (13) of the coaxial plug (12) through the selector terminals (21), wherein, the elastic member, which moves the selector terminals (21) in a direction away from the one of the pair of contacts (6), by its elastic recovering force, is constructed from a coned disc spring or a leaf spring (22). This arrangement reduces the height of the connector, facilitates the assembly and reduces the number of parts.

10 Claims, 9 Drawing Sheets

A STATE OF FITTING IN FIG.4

COAXIAL CONNECTOR WITH SELECTOR SWITCH

TECHNICAL FIELD

The present invention relates to a coaxial connector with a selector switch for cellular phones and radio sets.

BACKGROUND ART

Many electronic devices such as cellular phones and radio sets have on their internal printed circuit boards a coaxial connector with a selector switch for use during inspection and maintenance.

In this kind of selector switch-incorporating coaxial connector used on cellular phones, a receptacle of the connector has, for example, a construction in which a first contact connected to a transmission/reception circuit and a second contact connected to an antenna of the cellular phone are normally closed. For inspection, a coaxial plug connected with a measuring instrument is inserted into the receptacle to bring the first and second contacts out of conduction and connect the first contact to the coaxial plug.

FIG. 8 shows a conventional construction of the connector of this kind.

In the receptacle of the conventional connector shown in FIG. 8, a first contact 52 and a second contact 53 are arranged in a plug insertion hole 51 formed in a connector housing 50 made from an insulating material. The first contact 52 is connected, for example, to the above-described transmission/reception circuit of a cellular phone. The second contact 53 is connected to an antenna of the cellular phone. The plug insertion-side end of the connector housing 50 is covered with a metal shell 54 that is brought into contact with an outer conductive contact of the inserted coaxial plug.

The first contact 52 and the second contact 53 are normally in contact with each other. Accordingly, the transmission/reception circuit is connected to the antenna of the cellular phone through the first contact 52 and the second contact 53.

When, for inspection, a coaxial plug connected with a measuring instrument through a coaxial cable is inserted into the plug insertion hole 51, it pushes down the first contact 52 to part from the second contact 53. At the same time, the first contact 52 touches an exposed, center conductive contact provided at the front end of the coaxial plug. The metal shell 54 touches an external conductive (wire mesh) contact of the coaxial plug. As a result, the transmission/reception circuit is connected, through the first contact 52 and the contact of the coaxial plug, to the measuring instrument attached to the coaxial cable.

The conventional technology shown in FIG. 8 has a drawback that because the contact portion of the first contact 52 and the second contact 53 are exposed to the outside as they are, dirt and dust are trapped in the contact portion, resulting in easily generating a poor electrical contact.

FIG. 9 shows another conventional technology that overcomes the problem described above.

In this conventional technology, the contact portion of the first contact 52 and the second contact 53 are covered with an upper housing 55A. A guide hole 56, in which a selector terminal 57 is movably fitted, is formed at the upper housing 55A.

When the coaxial plug is not inserted, the first contact 52 and the second contact 53 come in contact with each other, as in the preceding example. The front flange portion 57A of the selector terminal 57 is in contact with the first contact 52 at all times.

When the coaxial plug is inserted into the plug insertion hole 51, it pushes down the selector terminal 57 and therefore the first contact 52, causing the contact portion of the first contact 52 to part from the second contact 53. As a result, the first contact 52 is connected to the center conductive contact of the inserted coaxial plug through the selector terminal 57, as with the above.

In the conventional technology shown in FIG. 9, although it is possible to prevent infiltration of dust because the contact portion of the contacts are covered, there are some problems that an impedance matching between the measuring instrument and the transmission/reception circuit is difficult, and thus, a high frequency characteristic degrades, since the selector terminal 57 comes always in contact with the first contact 52. Further, a thickness of the front flange portion 57A of the selector terminal 57 needs to have a thickness that allows for a clearance At equal to the thickness of the second contact 53 in order to ensure a reliable touch between the first contact 52 and the second contact 53. This construction may result in the front flange portion 57A of the selector terminal 57 coming into contact at one time and out of contact at other times due to the clearance at the time when vibrations are created, deteriorating the high frequency characteristic.

FIG. 10 shows still another conventional technology that overcomes these problems.

In this conventional technology, the selector terminal 57 is urged (upward) toward a coaxial plug 60 side by a coil spring 58. In the normal state in which the coaxial plug 60 is not inserted, the selector terminal 57 is out of contact with the first contact 52. An insulator 59 is interposed between the coil spring 58 and the selector terminal 57.

As shown in FIG. 10, when the coaxial plug 60 is inserted into the plug insertion hole 51, the selector terminal 57 is pushed down against the force of the coil spring 58. Accordingly, the first contact 52 is pushed down to part from the second contact 53. As a result, the first contact 52 is connected to a center conductive contact 61 of the coaxial plug 60 through the selector terminal 57, as described in the previous example. A metal shell 54 on the receptacle side touches an outer conductive contact 62 of the coaxial plug 60.

With this conventional technology, it is therefore possible to make an improvement on the problem of the deteriorated high frequency characteristic experienced with the conventional technology of FIG. 9 which is caused by the continual contact of the selector terminal 57 or by the intermittent contacting and parting action of the selector terminal 57 due to vibrations.

In the conventional technology of FIG. 10, however, the use of the coil spring 58 increases the height of the receptacle of the connector. Hence, it hinder a reduction in the size of the connector. The connector of this kind used on electronic devices such as cellular phones is normally required to have a height of the order of several millimeters and an increasingly smaller height of the receptacle of the connector is being called for.

Further, because the receptacle of the connector of this conventional technology uses a coil spring, an automatic assembly using an automated machine is difficult, making the manufacturing efficiency low. Furthermore, the use of the coil spring increases the number of parts, which is detrimental to a cost reduction.

The present invention has been accomplished under these circumstances and it is an object of the invention to provide a selector switch-incorporating coaxial connector which can realize a reduction in the connector height, make the assembly easy and reduce the parts count.

DISCLOSURE OF INVENTION

A coaxial connector with a selector switch comprising: a receptacle housing made from an insulator; a pair of contacts provided in a space formed in the receptacle housing and a point of said contacts coming in contact with each other; a onductive selector terminal movably supported in an opening formed in the receptacle housing to enable one of the pair of contacts to push in a direction that parts the paired contacts from each other; and an elastic member moving the selector terminal in a direction away from the one of the pair of contacts by an elastic recovering force thereof; wherein a pressing force of the coaxial plug as it is connected to the coaxial connector is applied to the one of the pair of contacts through the selector terminal to separate the pair of contacts from each other and to electrically connect the one of the pair of contacts to a contact of the coaxial plug through the selector terminal; wherein the elastic member is constructed from a coned disc spring or a leaf spring.

The selector terminal, for example, extends from an almost central portion of the coned disc spring or the leaf spring toward the opening in the receptacle housing.

The elastic member constructed from the leaf spring or the coned disc spring and the selector terminal can be formed in form of single-piece from a thin metal plate. The coned disc spring may be formed from a rubber material.

Because in the switch-incorporating coaxial connector of this invention the elastic member for urging the selector terminal is constructed from a coned disc spring or a leaf spring, the height of the connector structure can be reduced and the assembly during the manufacture simplified. This arrangement also allows for automated assembly using machines. If the elastic member constructed from a coned disc spring or a leaf spring and the selector terminal are formed in form of single-piece from a thin metal plate, the number of parts can be reduced contributing to a cost reduction.

BEST MODE FOR CARRYING OUT THE INVENTION

Now, embodiments of this invention will be described in detail by referring to the accompanying drawings.

Figure 1:
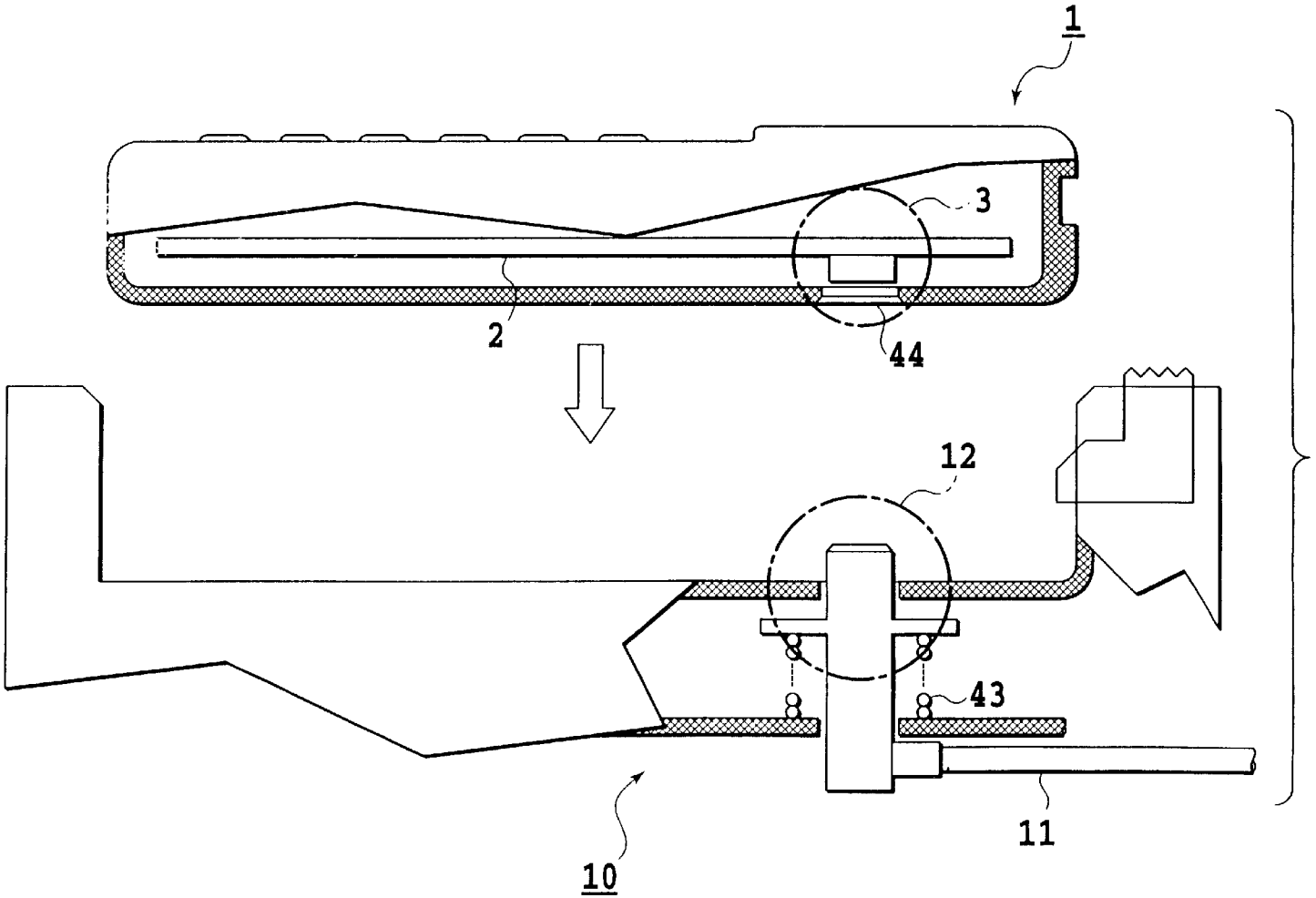
FIG. 1 is a cross section showing a cellular phone using the switch-incorporating connector according to the present invention and also a inspection mount for inspecting the cellular phone.

FIG. 1 illustrates a cellular phone 1 as one example of an electronic device using the selector switch-incorporating coaxial connector according to the present invention, and also an inspection mount 10.

In the cellular phone 1, a receptacle 3 of a coaxial connector with a selector switch is mounted on a built-in printed circuit board 2. The cellular phone 1 has an insertion hole 44 for a coaxial plug 12 formed therein at a location corresponding to the receptacle 3 of the coaxial connector.

The inspection mount 10 has the coaxial plug 12 connected with a coaxial cable 11. The coaxial plug 12 is urged upward by a coil spring 43. When the cellular phone 1 is placed on the inspection mount 10, the coaxial plug 12 is coupled to the receptacle 3 of the coaxial connector by the urging force of the coil spring 43 and fixed therein.

Figure 2A:
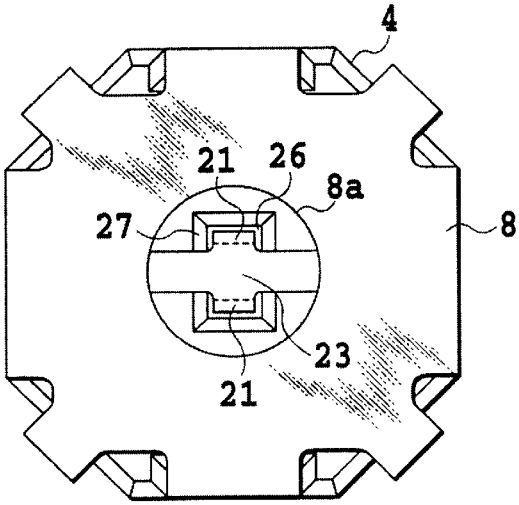
FIG. 2A is a plan view showing a first embodiment of the switch-incorporating connector according to the invention.
Figure 2B:
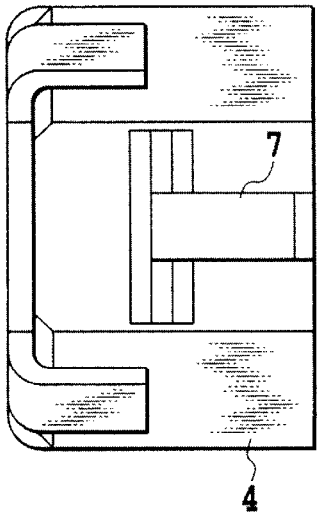
FIG. 2B is a side view of FIG. 2A.
Figure 2C:
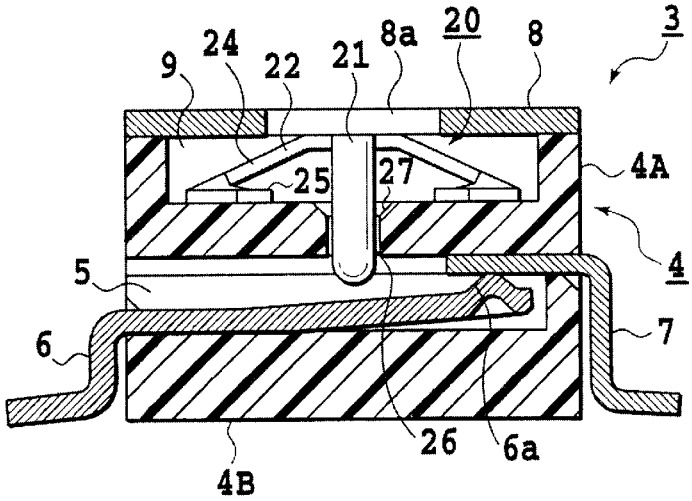
FIG. 2C is a cross section of FIG. 2A.

FIG. 2 shows a first embodiment of the receptacle 3 of the coaxial connector with a selector switch, with FIG. 2A representing a plan view, FIG. 2B a side view and FIG. 2C a cross section.

As shown in FIGS. 2A to 2C, the receptacle 3 of the connector has a housing 4 comprising an upper housing 4A and a lower housing 4B. In a gap 5 between the upper housing 4A and the lower housing 4B, a first contact 6 and a second contact 7 are installed. The first contact 6 is made from a cantilevered metal contact leaf spring, the resilient force of which keeps a contact point 6*a* of the first contact 6 in contact with the second contact 7. The first contact 6 is connected to a transmission/reception circuit (not shown) through wiring of the printed circuit board 2. The second contact 7 is connected to an antenna (not shown) of the cellular phone 1 through wiring of the printed circuit board 2.

A metal shell 8 is provided at the edge of the upper side of the upper housing 4A so that it is covered with the metal shell 8. At the center of the metal shell 8 is formed an opening 8*a* through which a center conductive contact 13 of the coaxial plug 12 (see FIG. 4A) is inserted.

Figure 3A:
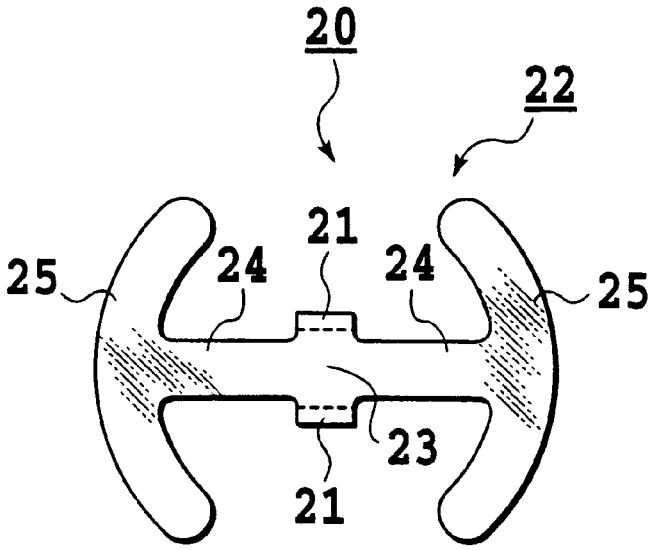
FIG. 3A is a plan view showing a selector terminal member used in the connector given in FIG. 2A.
Figure 3B:
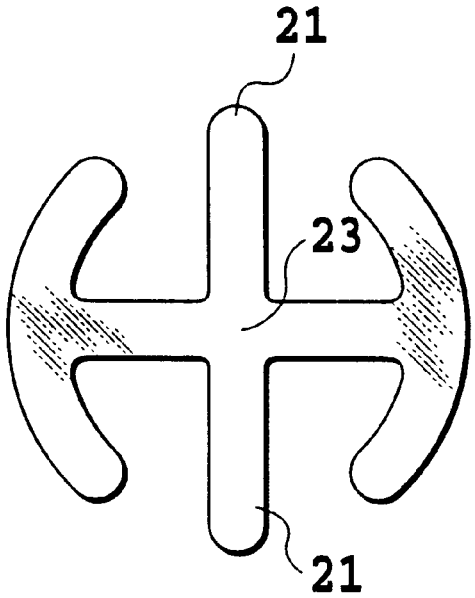
FIG. 3B is a developed plan view of the selector terminal member.

In a space 9 enclosed by the metal shell 8 and the upper housing 4A, a selector terminal member 20 is installed. FIG. 3A is a plan view of the selector terminal member 20, and FIG. 3B shows an unfolded state of the selector terminal member 20 before being bent.

The selector terminal member 20 comprises selector terminals 21 and a coned disc spring 22 which are formed in one piece from a thin metal plate. That is, as shown in FIG. 3B, a pair of selector terminals 21 extending horizontally from a central seating portion 23 are bent almost at a bend angle of right angles to extend vertically downwardly relative to the coned disc spring 22.

The coned disc spring 22 has a pair of spring strip portions 24 bent at a predetermined angle and extending laterally from the seating portion 23 and an arc seating portion 25 connected to the spring strip portions 24. While in this case the seating portion 25 is divided in two, it may be formed like a complete annular ring.

The underside of the upper housing 4A is formed with openings 26 through which the selector terminals 21 pass. A taper 27 is formed at the inlet side wall surface of the brim of each opening 26 in order to facilitate the insertion of the selector terminals 21.

In this construction, in the normal state where the coaxial plug 12 is not inserted, the underside ends of the selector terminals 21 are spaced from the first contact 6, and the first contact 6 and the second contact 7 are in an electric conductive condition. That is, in this state, the transmission/reception circuit is connected to the antenna of the cellular phone 1 through the first contact 6 and the second contact 7.

Figure 4A:
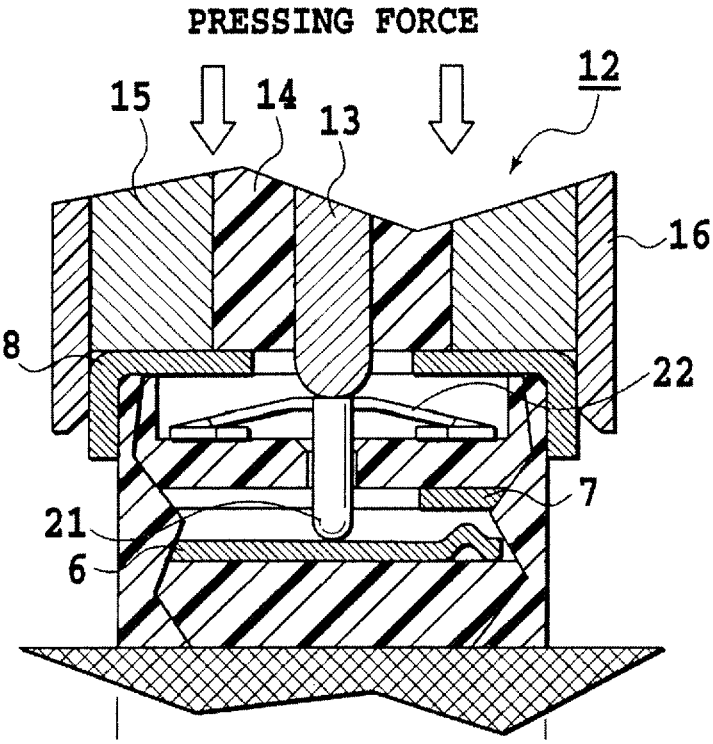
FIG. 4A is a cross section showing the switch-incorporating connector given in FIG. 1 when a coaxial plug is connected.
Figure 4B:
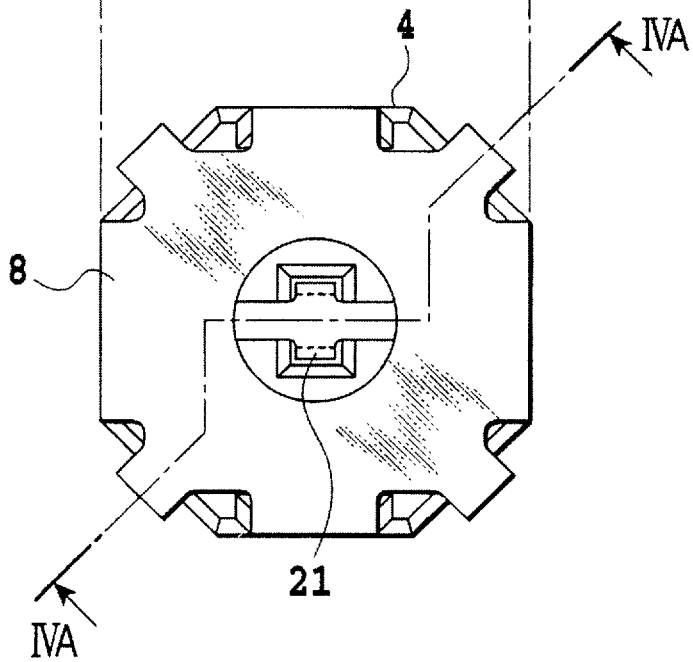
FIG. 4B is a plan view of the same.

When the cellular phone 1 is put on the inspection mount 10 presented in FIG. 1, the coaxial plug 12 is coupled to housing 4 as shown in FIG. 4A and FIG. 4B.

The coaxial plug 12 in this embodiment comprises a center conductive contact 13, an insulator 14 around the center conductive contact 13, an outer conductive contact 15 and a casing 16. When the coaxial plug 12 is connected, the front end of the exposed center conductive contact 13 pushes down the seating portion 23 of the selector terminal member 20, thereby moving the selector terminals 21 downward against the force of the coned disc spring 22. The underside end of the selector terminals 21 push down the first contact 6. The result is that the first contact 6 parts from the second contact 7. Because the underside end of the selector terminals 21 comes in contact with the first contact 6, the first contact 6 is electrically connected to the center conductive contact 13 of the coaxial plug 12 through the selector terminals 21. The metal shell 8 comes in contact with the outer conductive contact 15 of the coaxial plug 12. As a result, the transmission/reception circuit is connected to a measuring instrument attached to a coaxial cable 11 through the first contact 6, the selector terminals 21 and the center conductive contact 13 of the coaxial plug 12.

When the coaxial plug 12 is disconnected from the receptacle, the recovering force of the coned disc spring 22 restores the selector terminal member 20 to the original state shown in FIG. 2C with the result that the first contact 6 reestablishes an electrical connection with the second contact 7.

Figure 5A:
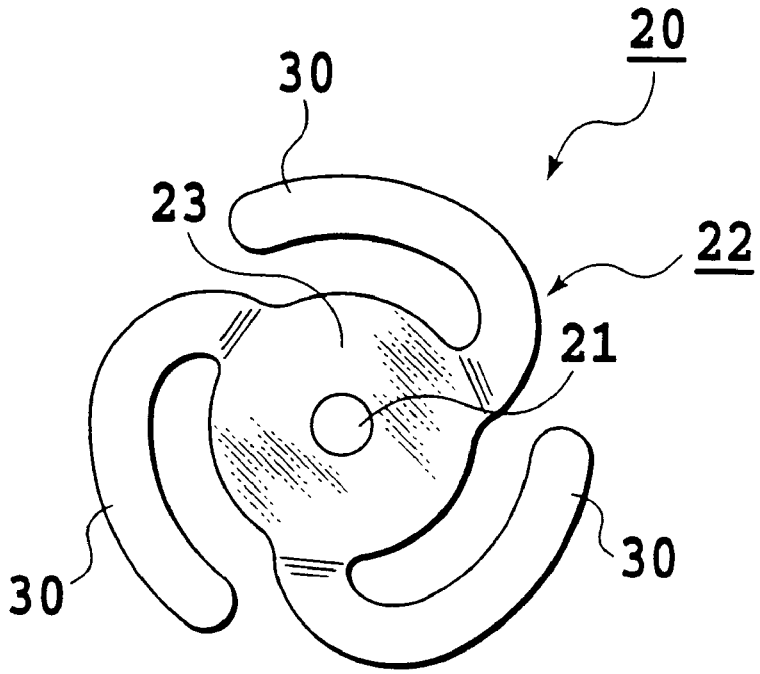
FIG. 5A is a plan view showing a second embodiment of the selector terminal member.
Figure 5B:
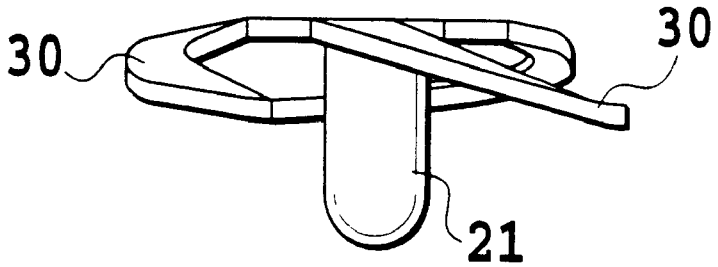
FIG. 5B is a front view of the same.

FIG. 5A and FIG. 5B show another embodiment of the selector terminal member 20.

In this case, a selector terminal member 20 has a plurality of spring strip portions 30 which extend from the seating portion 23 in a circumferential direction such that the spring strip portion 30 define a spiral form. These spring strip portions 30 and the seating portion 23 constitute the coned disc spring 22. The selector terminal member 20 has a selector terminal 21 which extends downwardly from the underside of the seating portion 23, as in the previous example. The spring strip portions 30 are bent at a predetermined angle to the seating portion 23.

Figure 6A:
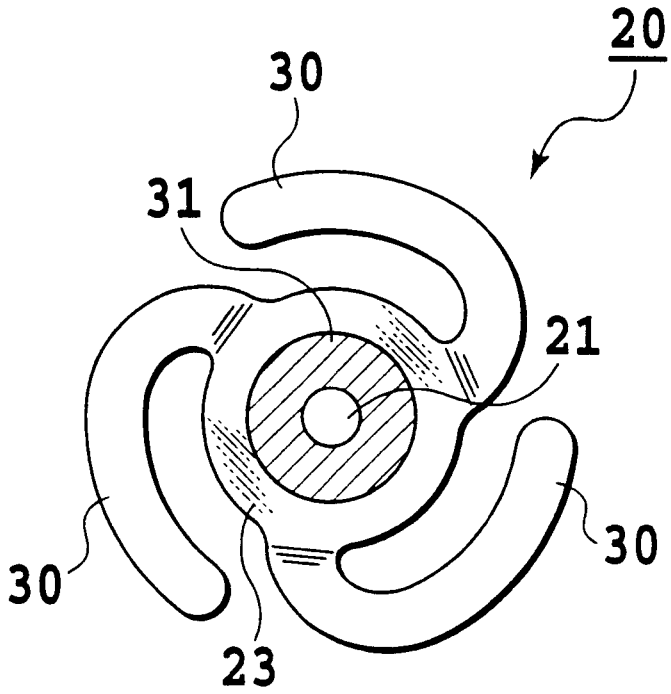
FIG. 6A is a plan view showing a third embodiment of the selector terminal member.
Figure 6B:
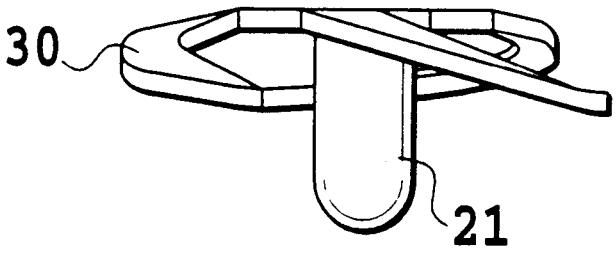
FIG. 6B is a front view of the same.

FIG. 6A and FIG. 6B show a variative example of the embodiment of FIG. 5. In this case, The selector terminal member 20 has an insulator 31 which is installed in the seating portion 23. The insulator 31 provides electrical isolation between the selector terminals 21 and the spring strip portions 30 such that those define a spiral form. Because the spring strip portions 30 are insulated from the selector terminal 21, the shape of the spring strip portions 30 does not adversely influence the impedance matching between the transmission/reception circuit and the measuring instrument, thus improving the high frequency characteristic.

Figure 7A:
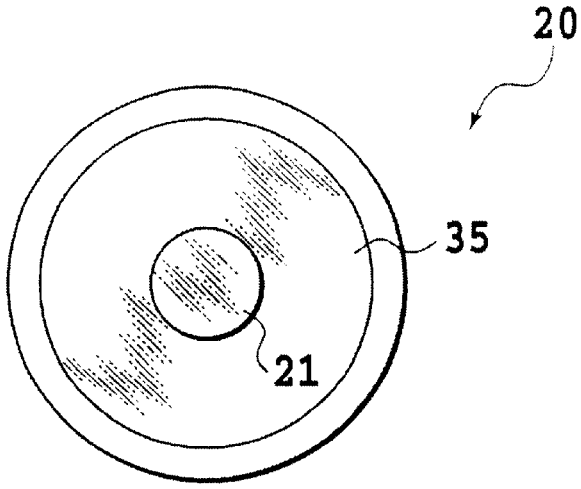
FIG. 7A is a plan view showing a fourth embodiment of the selector terminal member.
Figure 7B:
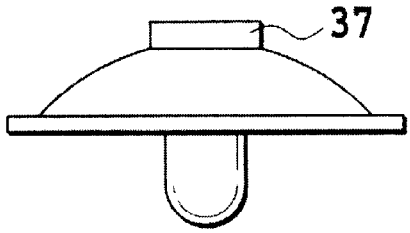
FIG. 7B is a front view of the same.
Figure 7C:
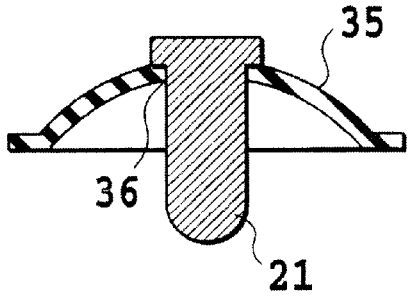
FIG. 7C is a cross section of the same.
Figure 8:
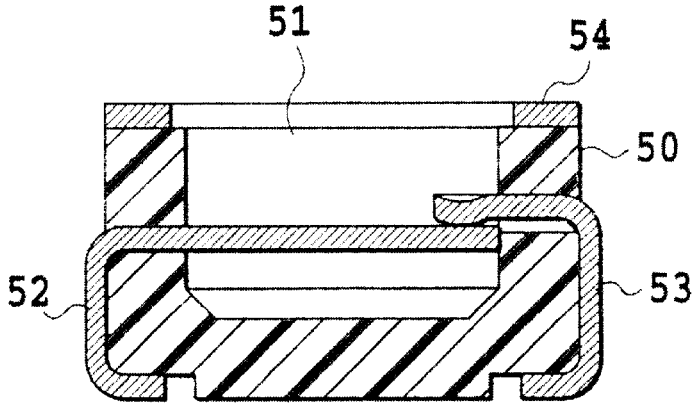
FIG.8 PRIOR ART
FIG. 8 is a cross section showing a conventional technology of the switch-incorporating connector.
Figure 9:
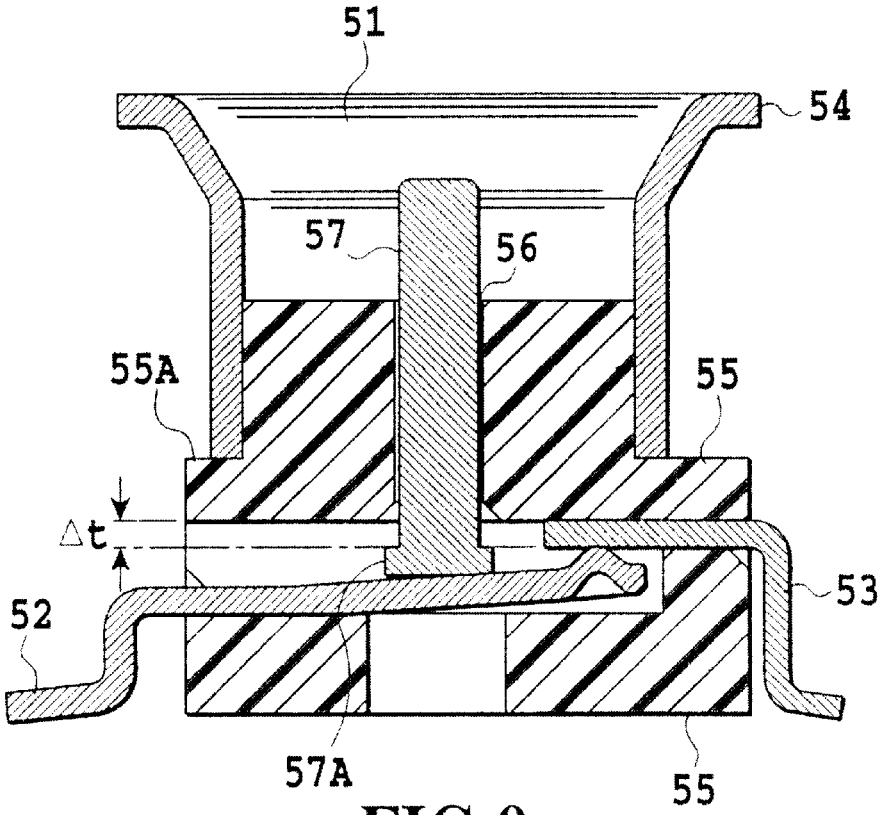
FIG.9 PRIOR ART
FIG. 9 is a cross section showing another conventional technology of the switch-incorporating connector.

FIG. 7A to FIG. 7C show still another embodiment of the selector terminal member 20.

In this embodiment, the coned disc spring 22 is constructed from a dish-shaped rubber element 35. An opening 36 is formed at the center of the dish-shaped rubber element 35. The selector terminal 21 with a flanged head 37 as a stopper formed at the top is inserted into the opening 36. In this case, too, because the dish-shaped rubber element 35 is an insulator, the impedance matching is not adversely affected.

With the construction of the receptacle for selector switch-incorporating connector described above, because an elastic member for urging the selector terminals 21 toward the coaxial plug 12 is made from a coned disc spring, The reduction of the height of the construction of the receptacle of the connector can be planned and downsizing.

Further, the selector terminals 21 and the coned disc spring 22 of the selector terminal member 20 are formed in form of single-piece construction from a thin metal plate. This construction makes it possible to reduce the number of parts and therefore the cost, compared with the conventional technology. This construction also facilitates the assembly of the receptacle of the connector in the production line. That is, because the selector terminal member 20 can be assembled into the housing by simply putting it on the upper housing 4A at the condition that the selector terminals 21 is inserted into the openings 26 of the upper housing 4A, the labor hour it takes to assemble the selector terminal member 20 can be made significantly smaller than the labor hour taken by the conventional technology that requires an unwieldy coil spring which is incorporated during the assembly.

Further, according to the construction of the receptacle of the connector described above, because the first contact 6 and the second contact 7 are covered with the upper housing 4A and the selector terminals 21, the infiltration of dust and dirt can be prevented, thus bringing a reliable touching between these contacts. Further, the selector terminals 21 touches the first contact 6 only when the coaxial plug 12 is connected, so that the high frequency characteristic is not adversely affected during the ordinary use.

Although in the above embodiments the selector terminals 21 are elastically urged by the coned disc spring, it may be urged by a leaf spring. The use of a leaf spring can also offer advantages such as a reduced height, a cut in parts count and an easy assembly, as does the coned disc spring. Further, the coned disc spring is not limited to those shapes presented in the embodiments above and may take any arbitrary form.

Although the selector terminals 21 and the coned disc spring 22 are formed in form of single-piece from one thin metal plate in the embodiments above, they may be formed as separate members and joined together as by drive fit.

Figure 10:
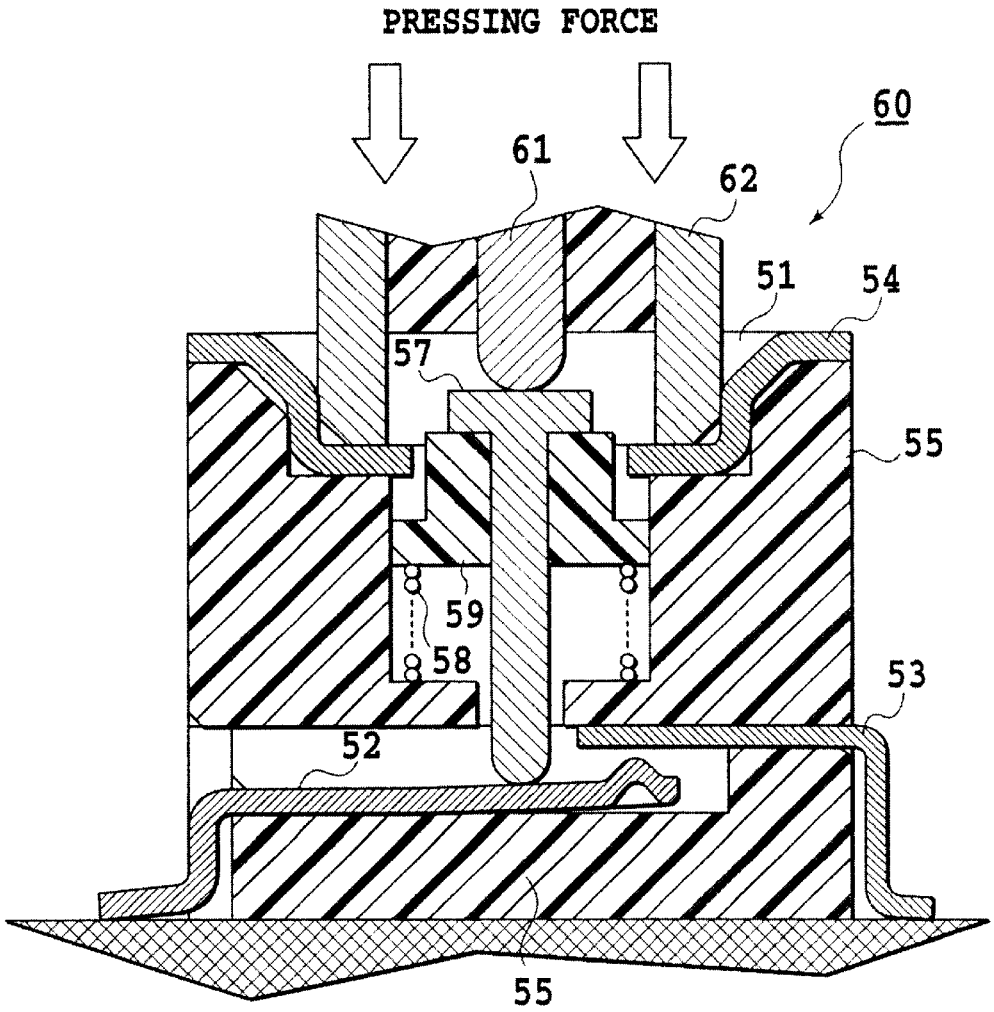
FIG.10 PRIOR ART
FIG. 10 is a cross section showing still another conventional technology of the switch-incorporating connector.

Although in the embodiments above the receptacle 3 of the connector is inserted into the casing 16 of the coaxial plug 12 to connect them together, the coaxial plug 12 may be inserted into the receptacle 3 of the connector as shown in FIG. 10.

The applications of the connector with a selector switch according to this invention are not limited to the radio sets such as cellular phones but also include printed circuit boards, semiconductor package boards and MCM boards used on personal computers, peripheral devices such as printers, displays, FDDs, HDDs and memory cards, automotive navigation devices, video cameras, and CD players. The connector of this invention can also be applied to automotive and satellite equipment.

INDUSTRIAL APPLICABILITY

In the switch-incorporating coaxial connector of this invention, because the elastic member for urging the selector terminals is constructed from a coned disc spring or a leaf spring, it is possible to reduce the height of the connector structure and simplify the assembly work during the manufacture. This construction also allows for automated assembly using a machine. The elastic member made of a coned disc spring or leaf spring and the selector terminals are formed in form of single-piece from thin metal plate whereby being able to reduce the number of parts to contribute to a cost reduction.

What is claimed is:

1. A coaxial connector comprising:

a receptacle housing made from an insulator, the receptacle housing having a space and an opening formed therein;

a pair of contacts provided in said space formed in said receptacle housing, said contacts being in contact with each other;

a conductive selector terminal movably supported in said opening formed in said receptacle housing to push one of said pair of contacts in a direction separating said pair of contacts from each other; and a coned disc spring urging said selector terminal in a direction away from the one of said pair of contacts by an elastic recovering force thereof, wherein said coned disc spring and said selector terminal are formed as a single piece.

2. A coaxial connector according to claim 1, wherein said coned disc spring and said selector terminal are formed from a thin metal plate.

3. A coaxial connector according to claim 1, wherein said selector terminal extends from a substantially central portion of said coned disc spring toward said opening in said receptacle housing.

4. A coaxial connector according to claim 1, wherein said receptacle housing has an upper housing and a lower housing, and said opening is formed in said upper housing.

5. A coaxial connector according to claim 1, wherein an insulator is provided between said coned disc spring and said selector terminal.

6. A coaxial connector comprising:

a receptacle housing made from an insulator, the receptacle housing having a space and an opening formed therein;

a pair of contacts provided in said space formed in said receptacle housing, said contacts being in contact with each other;

a conductive selector terminal movably supported in said opening formed in said receptacle housing to push one of said pair of contacts in a direction separating said pair of contacts from each other; and a leaf spring urging said selector terminal in a direction away from the one of said pair of contacts by an elastic recovering force thereof, wherein said leaf spring and said selector terminal are formed as a single piece.

7. A coaxial connector according to claim 6, wherein said leaf spring and said selector terminal are formed from a thin metal plate.

8. A coaxial connector according to claim 6, wherein said selector terminal extends from a substantially central portion of said leaf spring toward said opening in said receptacle housing.

9. A coaxial connector according to claim 6, wherein said receptacle housing has an upper housing and a lower housing, and said opening is formed in said upper housing.

10. A coaxial connector according to claim 6, wherein an insulator is provided between said leaf spring and said selector terminal.

* * * * *